US012704054B2

(12) United States Patent
Ryan et al.

(10) Patent No.: US 12,704,054 B2
(45) Date of Patent: Aug. 11, 2026

(54) MULTIMODAL PARTICAL DIVERTER FOR COMPLEX COMPLETIONS

(71) Applicant: Schlumberger Technology Corporation, Sugar Land, TX (US)

(72) Inventors: Abraham Ryan, Abu Dhabi (AE); Vaishak Basavraj Arali, Abu Dhabi (AE); Gustavo Armando Araque Martinez, Abu Dhabi (AE); Philippe Enkababian, Doha (QA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/293,470

(22) Filed: Aug. 7, 2025

(65) Prior Publication Data

US 2026/0043321 A1 Feb. 12, 2026

Related U.S. Application Data

(60) Provisional application No. 63/680,355, filed on Aug. 7, 2024.

(51) Int. Cl.
*E21B 43/14* (2006.01)
*E21B 43/27* (2006.01)

(52) U.S. Cl.
CPC ..... *E21B 43/14* (2013.01); *E21B 43/27* (2020.05)

(58) Field of Classification Search
CPC ..... E21B 43/14; E21B 43/27; E21B 43/267
USPC ..... 166/305.1
See application file for complete search history.

(56) References Cited

U.S. PATENT DOCUMENTS

| | | | | |
|---|---|---|---|---|
| 7,934,556 | B2 | 5/2011 | Clark | |
| 8,167,043 | B2 | 5/2012 | Willberg | |
| 8,220,543 | B2 | 7/2012 | Clark | |
| 8,656,529 | B2 | 2/2014 | Corriveau | |
| 8,714,248 | B2 * | 5/2014 | Hughes | C09K 8/80 166/305.1 |
| 8,726,991 | B2 | 5/2014 | Boney | |
| 8,905,133 | B2 | 12/2014 | Potapenko | |
| 9,322,260 | B2 | 4/2016 | Potapenko | |
| 10,030,471 | B2 | 7/2018 | Lecerf | |

(Continued)

*Primary Examiner* — Nicole Coy
*Assistant Examiner* — Douglas S Wood
(74) *Attorney, Agent, or Firm* — Jeffrey D. Frantz

(57) ABSTRACT

A system and method are provided for stimulating heterogeneous subterranean formations using a tailored particulate diverter (PD). In some embodiments, a wellbore completion string includes an inflow control device (ICD) positioned in a high-permeability zone and an additional completion section positioned in a lower-permeability zone. The ICD includes restrictive openings, such as nozzles or valves, configured to impose a predictable pressure drop to balance inflow during production. During stimulation, the tailored particulate diverter comprising degradable diverter particles suspended in a carrier fluid is pumped into the completion string. The diverter particles exhibit a multimodal particle size distribution with at least four distinct size modes selected to bridge and seal the restrictive openings of the ICD, diverting stimulation fluid into the lower-permeability zone. Following treatment, the diverter particles degrade under downhole conditions to restore flow through the restrictive openings, improving stimulation coverage and enhancing overall production and/or injection efficiency.

20 Claims, 8 Drawing Sheets

(56) References Cited

U.S. PATENT DOCUMENTS

| | | | | |
|---|---|---|---|---|
| 10,301,903 | B2 | 5/2019 | Payne | |
| 2006/0118301 | A1* | 6/2006 | East, Jr. | E21B 43/26 166/308.2 |
| 2008/0156496 | A1* | 7/2008 | East | E21B 43/10 166/54.1 |
| 2014/0096970 | A1* | 4/2014 | Andrew | E21B 43/26 166/308.1 |
| 2014/0345863 | A1* | 11/2014 | Ladva | E21B 47/113 137/13 |
| 2016/0237782 | A1 | 8/2016 | Carrejo | |
| 2018/0163512 | A1 | 6/2018 | Payne | |
| 2022/0034212 | A1* | 2/2022 | Nguyen | C09K 8/88 |
| 2022/0090475 | A1* | 3/2022 | Radwan | E21B 33/138 |

* cited by examiner

MULTIMODAL PARTICAL DIVERTER FOR COMPLEX COMPLETIONS

CROSS REFERENCE TO RELATED APPLICATIONS

This application claims priority to and the benefit of U.S. Provisional Patent Application No. 63/680,355, filed on Aug. 7, 2024, which is hereby incorporated by reference in its entirety.

BACKGROUND OF THE DISCLOSURE

Wellbores may be drilled into a surface location or seabed for a variety of exploratory, extraction, and/or injection purposes. For example, a wellbore may be drilled to access fluids, such as liquid and gaseous hydrocarbons, stored in subterranean formations and to extract the fluids from the formations. Wellbores used to produce or extract fluids may be formed in earthen formations using earth-boring tools such as drill bits for drilling wellbores and reamers for enlarging the diameters of wellbores.

Many formations are heterogeneous, with zones of varying permeability. High-permeability zones often dominate production while lower-permeability zones contribute little. Accordingly, completions may typically implement inflow control devices specifically designed to balance inflow and/or outflow by imposing a predictable, engineered flow restriction to high-permeability zones to promote fluid production and injection from lower-permeability zones. These completions, however, can lead to imbalances in fluid flow during stimulation operations such that lower-permeability zones needing treatment may not be adequately stimulated.

SUMMARY

In some embodiments, a particulate diverter is described herein for use in a wellbore completion system including an inflow control device (and/or an outflow control device) configured to produce a production fluid from a heterogeneous formation. The particulate diverter includes a carrier fluid, and a plurality of diverter particles suspended in the carrier fluid. The plurality of diverter particles are degradable and have a multimodal particle size distribution including at least four modes. Additionally, the plurality of diverter particles are sized and configured, based on the at least four modes, to temporarily block restrictive openings of the inflow control device during a stimulation operation of the heterogeneous formation (e.g., and/or in some implementations outflow control devices of an injection operation) with the wellbore completion system.

In some embodiments, a wellbore completion system implemented in a wellbore for producing a production fluid from a heterogeneous formation includes a completion string. The completion string includes an inflow control device positioned in the wellbore at a first portion of the heterogeneous formation exhibiting a first permeability that is greater than a second permeability at a second portion of the heterogeneous formation. The inflow control device includes one or more restrictive openings configured to restrict a flow of the production fluid into the completion string at the first portion of the heterogeneous formation exhibiting the first permeability. The wellbore completion system also includes a particulate diverter flowing within the completion string. The particulate diverter includes a plurality of diverter particles having a multimodal particle size distribution including at least four modes, wherein the plurality of diverter particles are sized, based on the at least four modes, to block the one or more restrictive openings of the inflow control device.

In some embodiments, a method of stimulating a heterogeneous formation includes flowing a particulate diverter through a completion string within a wellbore positioned within the heterogeneous formation, wherein the particulate diverter comprises a plurality of diverter particles having a multimodal particle size distribution with at least four modes. The method includes blocking one or more restrictive openings of an inflow control device of the completion string with the plurality of diverter particles of the particulate diverter, the plurality of diverter particles being sized and configured according to the at least four modes and based on a size of the one or more restrictive openings, wherein the one or more restrictive openings of the inflow control device are configured to restrict a flow of a production fluid into the completion string from the heterogeneous formation. The method also includes flowing a stimulation fluid to the heterogeneous formation through the completion string, including restricting the flow of the stimulation fluid through the inflow control device to a first portion of the heterogeneous formation having a first permeability, based on the plurality of diverter particles blocking the one or more restrictive openings. Flowing the stimulation fluid additionally includes diverting the flow of the stimulation fluid to an additional completion section of the completion string based on restricting the flow of the stimulation fluid through the inflow control device, and flowing the stimulation fluid through the additional completion section of the completion string to a second portion of the heterogeneous formation having a second permeability that is less than the first permeability to stimulate the second portion of the heterogeneous formation.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 illustrates an example of a wellbore completion system disposed in a horizontal portion of a wellbore within a subterranean formation, according to at least one embodiment of the present disclosure;

FIG. 2-2 illustrates a cross-sectional view of a restrictive opening of an inflow control device as shown in FIG. 2-1, according to at least one embodiment of the present disclosure;

FIG. 3-1 illustrates an example of a particulate diverter, according to at least one embodiment of the present disclosure;

FIG. 3-2 illustrates an example particle size distribution of the particulate diverter of FIG. 3-1, according to at least one embodiment of the present disclosure;

FIG. 4-1 illustrates a schematic view of a restrictive opening of an inflow control device with diverter particles bridging and sealing the restrictive opening, according to at least one embodiment of the present disclosure;

FIG. 4-2 shows a schematic view of a wellbore completion system during a stimulation operation, according to at least one embodiment of the present disclosure.

DETAILED DESCRIPTION

Figure 1:
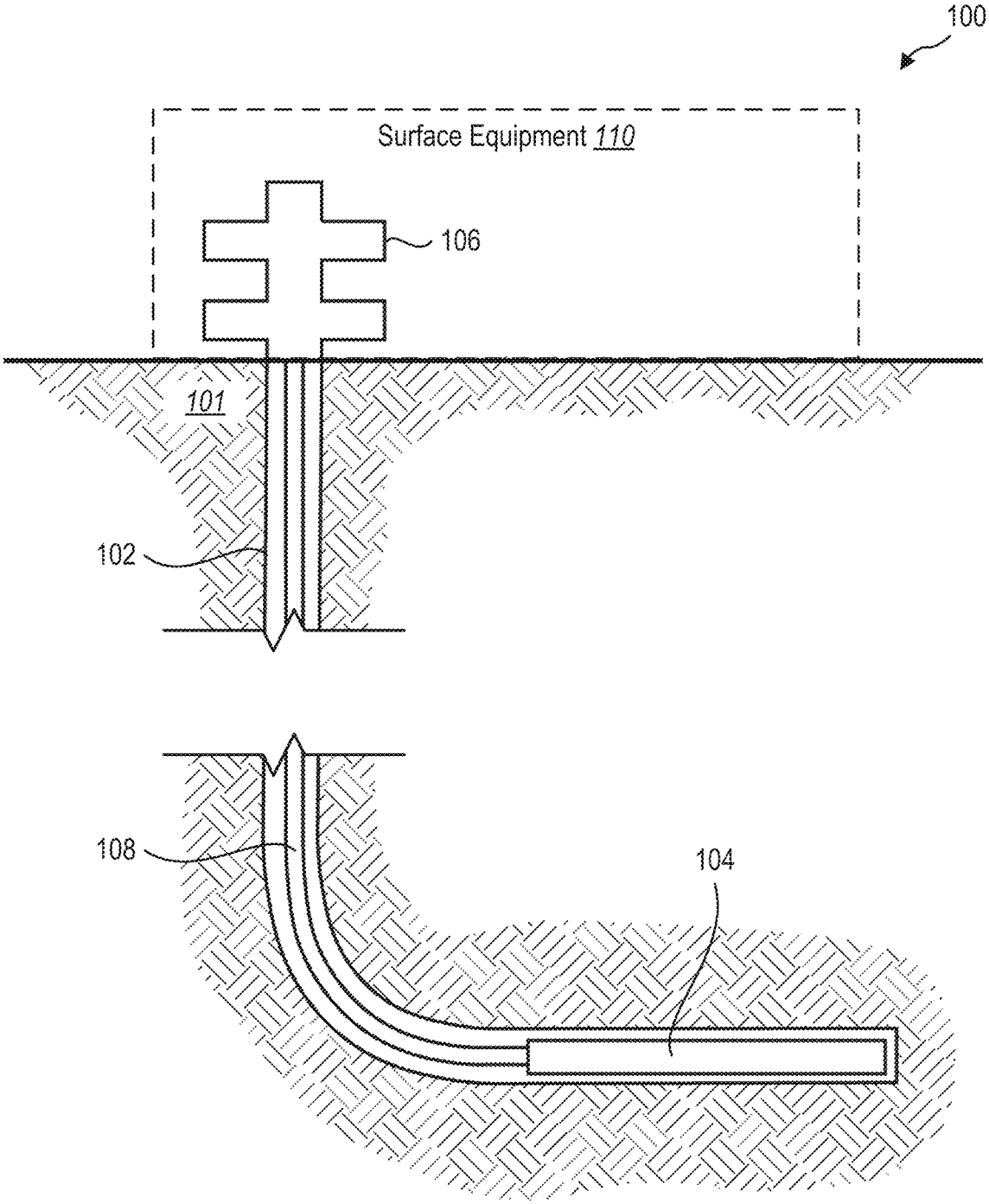
FIG. 1 is an example of a downhole system, according to at least one embodiment of the present disclosure.

This disclosure generally relates to systems and methods for stimulating subterranean formations. In hydrocarbon production, fluids are produced from a reservoir through a wellbore that penetrates the formation. Over time, or in certain formations, production may become suboptimal because of damage, blockage, or insufficient permeability near the wellbore. To enhance production, operators often stimulate the formation by pumping a fluid, such as an acid or other treatment fluid, into the wellbore to improve flow paths in the reservoir rock. In some embodiments, the formation is heterogeneous, with zones of varying permeability distributed along the length of the production zone of the wellbore. This heterogeneity results in differing flow characteristics of production fluid, as higher-permeability zones tend to dominate production while lower-permeability zones contribute less.

In order to achieve a more uniform flow of production fluid through the completion string, a wellbore system may be implemented with a complex completion, or a completion string which includes various components tailored to the flow characteristics of the different heterogeneous zones in order to achieve more uniform flow of the production fluid across all parts of the completion string. For instance, zones with greater permeability may be fitted with completion sections that are more restrictive to fluid flow in order to impose artificial flow resistance and promote flow contribution from lower-permeability zones.

While such a configuration may improve flow during production, during stimulation operations, this heterogeneity in permeability and flow characteristics presents challenges. For example, stimulation fluids tend to preferentially flow into the higher-permeability zones—where resistance is already lower—rather than into the lower-permeability zones that require treatment. As a result, the very zones that would benefit most from stimulation may remain untreated, leading to inefficient use of stimulation fluids, uneven reservoir drainage, and suboptimal production.

In some embodiments, a system and method for stimulating heterogeneous formations using a tailored particulate diverter is described herein. The system includes a particulate diverter slurry comprising degradable diverter particles suspended in a carrier fluid. The diverter particles are distributed across at least four modes in a multimodal particle size distribution. The discrete size ranges of the diverter particles are sized based on the geometry of restrictive openings (e.g., nozzles or valves) in the ICD. When pumped into the completion string, the diverter particles are carried by the fluid and bridge the restrictive openings of the ICD, forming a seal and blocking the restrictive openings.

In some embodiments, the completion string includes an ICD positioned in a high-permeability zone of the formation and an additional completion section, such as a pre-perforated liner, positioned in a lower-permeability zone. The particulate diverter slurry is delivered into the wellbore during stimulation, where the multimodal particle distribution is configured to temporarily block the restrictive openings of the ICD by bridging and sealing them. The diverter particles are degradable and may degrade over time under downhole conditions, such as due to temperature, pressure, chemical, or other degradation mechanisms after stimulation is complete.

According to one or more embodiments, by bridging and blocking the restrictive openings of the ICD, the particulate diverter slurry prevents stimulation fluid from flowing into the higher-permeability zone through the ICD. Instead, the stimulation fluid is diverted into the additional completion section positioned in the lower-permeability zone, thereby enhancing stimulation coverage in zones that would otherwise not be reached. The degradable nature of the diverter particles ensures that flow through the ICD is restored after stimulation, enabling more uniform production from both high- and low-permeability zones along the completion string. As a result, the stimulation techniques described herein improve reservoir contact, increase stimulation efficiency, and promote more balanced and effective production across the heterogeneous formation.

Additional details will now be provided regarding systems and methods described herein in relation to illustrative figures portraying example implementations. FIG. 1 shows one example of a downhole system 100 disposed in a formation 101, according to at least one embodiment of the present disclosure. The downhole system 100 includes a wellbore 102 drilled through the formation 101 and a completion string 104 installed in the wellbore 102. At the surface, the system 100 further includes a wellhead 106 and surface equipment 110 configured to deliver fluids into the wellbore 102.

As shown, the wellbore 102 includes a vertical section extending downward from the surface and a deviated section transitioning away from vertical, which may extend horizontally through the formation 101. The completion string 104 is typically positioned in a deviated and/or horizontal portion of the wellbore 102, such as in a production zone, to produce fluids from the formation 101. In some embodiments, the formation 101 is heterogeneous, with different zones having different permeability characteristics that affect the flow of fluids into the completion string 104. As described herein, the completion string 104 may include various completion components configured to regulate or direct flow from different portions of the formation 101, such as inflow control devices (ICDs), pre-perforated liners, limited-entry liners, open-hole intervals, or other completion sections and combinations thereof.

In various implementations, a tubing 108 extends from the surface through the wellbore 102 and connects at its lower end to the completion string 104. The tubing 108 provides a flow path between the surface equipment 110 and the completion string 104, enabling delivery of fluids such as particulate diverter slurry, stimulation fluid into the wellbore 102 and/or production fluid out of the wellbore 102. The tubing 108 may include production tubing, drill pipe, or any other suitable tubular conduit for conveying fluids between the surface and the completion string 104.

As shown, the downhole system 100 includes surface equipment 110. In addition to the wellhead 106, the surface equipment may include various other components such as drilling, completion, stimulation, intervention, and/or production equipment. For instance, the surface equipment 110 may include equipment used to mix and pump fluids into the wellbore 102. In some embodiments, the surface equipment 110 includes a blender or mixing unit for combining a carrier fluid and particulate diverter to form a slurry, one or more pumps for pressurizing and delivering the slurry and stimulation fluid downhole, storage tanks for the carrier fluid and particulate diverter materials, a control unit for monitoring and regulating operations, and other components. The surface equipment 110 may also include sensors, valves, manifolds, and other accessories depending on the specific application.

In general, the downhole system 100 may be configured to produce fluids from the formation 101 through the completion string 104, while enabling stimulation operations that, as described in one or more embodiments herein, preferentially treat zones of the formation 101 that would otherwise receive insufficient stimulation. Additional components or tools may also be included in the system 100, such as packers, screens, sand control devices, or other flow control equipment depending on the requirements of the reservoir and completion design.

Figures 1, 2:
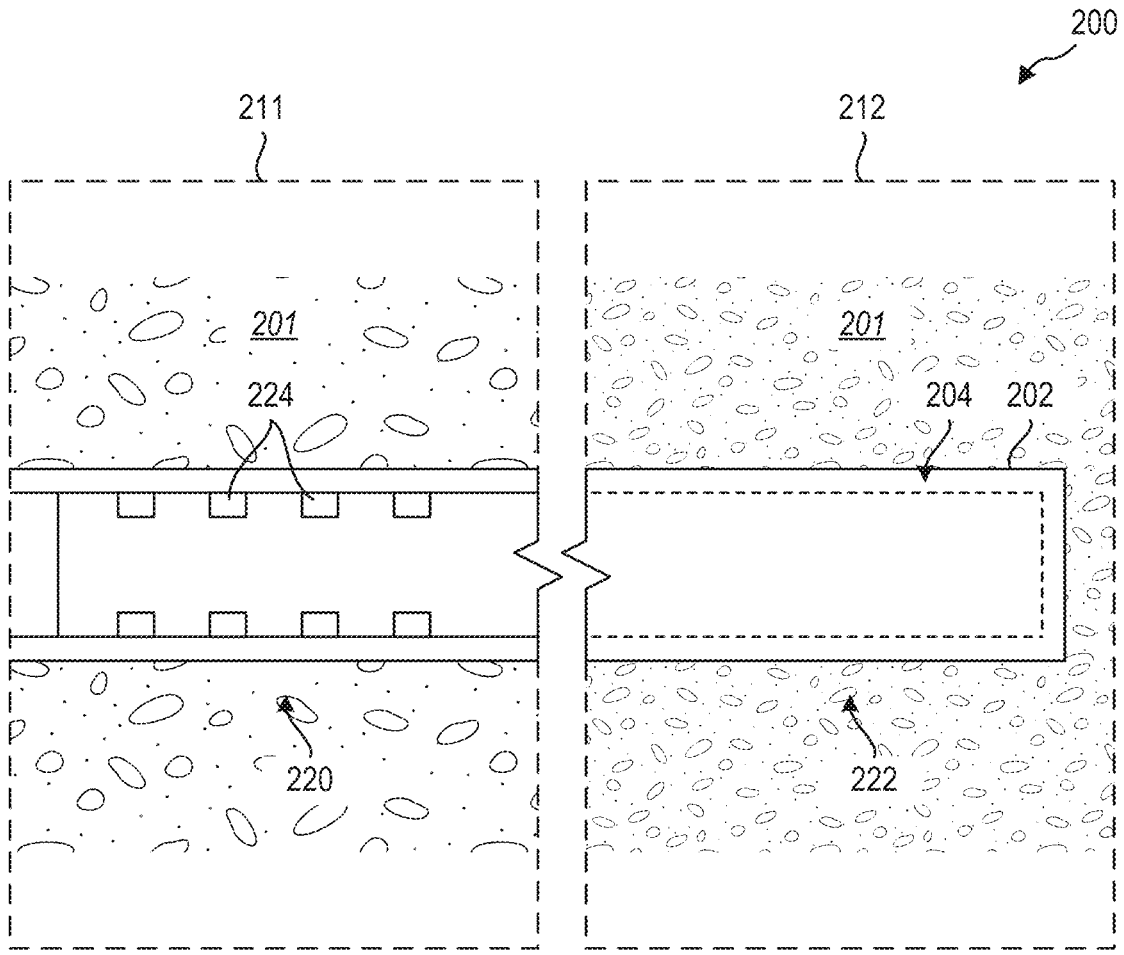
Figure 2:
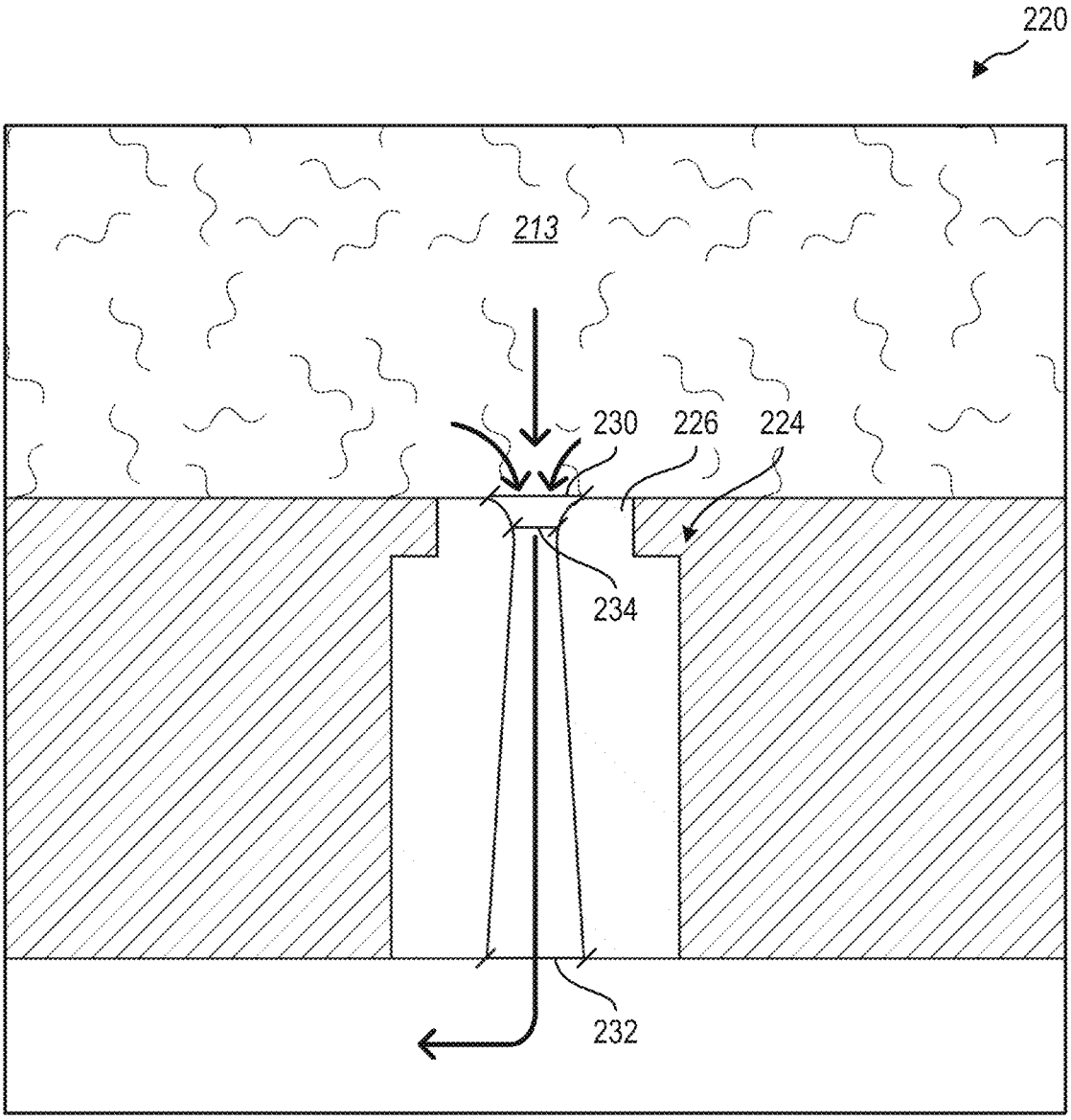

FIG. 2-1 illustrates an example of a wellbore completion system 200 disposed in a horizontal portion of a wellbore 202 within a subterranean formation 201, according to at least one embodiment of the present disclosure. As mentioned above, in some embodiments, the formation 201 may exhibit varying permeability (or other varying flow properties). For example, as shown in FIG. 2-1, the formation 201 includes a first zone 211 and a second zone 212 having different permeability. For example, the first zone 211 may have a greater permeability than the second zone 212. Such heterogeneity may arise from differences in rock type, porosity, natural fractures, and/or other geological features distributed along the length of the formation 201. In accordance with at least one embodiment, the formation 201 may be a carbonate formation, which may exhibit variations in permeability that differ by orders of magnitude within a matter of feet. Based on this heterogeneity, production fluids may tend to flow more readily from the first zone 211 having relatively greater permeability into the wellbore completion system 200, while flow contribution from the second zone 212 having relatively lower permeability may be limited or even negligible.

In some embodiments, the wellbore completion system 200 includes an inflow control device (ICD) 220. The inflow control device 220 may be implemented in the first zone 211 (e.g., having the higher permeability). An additional completion section 222 may be positioned at a different location along the length of the wellbore 202. For instance, the additional completion section 222 may be representative of one or more additional completion components or completion sections in addition to the ICD 220. For example, the additional completion section 222 may include one or more of a pre-perforated liner, a limited-entry liner, an open-hole interval, or other completion device or technique. In some embodiments, the additional completion section 222 may be a completion section (or multiple completion sections) that are non-restrictive completion sections, such as completion sections that, unlike the ICD 220, are not designed and/or intended to create artificial fluid resistance for production fluids flowing into the completion string. Accordingly, the ICD 220 may be positioned in the first zone 211 having the relatively higher permeability, while the additional completion section(s) 222 is/are positioned in the second zone 212 having a relatively lower permeability.

As shown in FIG. 2-1, the ICD 220 may include one or more restrictive openings 224, such as nozzles, valves, or other flow-restricting components. The restrictive openings 224 are configured to impose artificial flow resistance to production fluid entering the completion string from the formation 201. For instance, the restrictive openings 224 may be sized and shaped to regulate flow from the high-permeability first zone 211 of the formation 201 during production operations. The additional completion section 222 may include one or more non-restrictive components (e.g., pre-perforated liner, a limited-entry liner, or open-hole interval) and is positioned farther along the wellbore 202 to promote flow from the lower-permeability second zone 212 of the formation 201. By imposing resistance to flow from the first zone 211 via the ICD 220, production fluid from the second zone 212 is promoted, improving overall production. In some embodiments, the production rate from the first zone 211 may be reduced to be closer to the production rate of the second zone 212, resulting in more uniform production. In other embodiments, the flow from the first zone 211 may still exceed the flow from the second zone 212, but the imposed resistance still increases the contribution from the second zone 212.

As used herein, an "inflow control device" (ICD) refers to a downhole completion component specifically designed to impose a predictable, engineered flow restriction on fluids flowing from the surrounding formation into the completion string during production. Unlike other (e.g., non-restrictive) production components that may incidentally restrict flow, ICDs incorporate precisely machined flow paths-such as fixed-geometry nozzles, labyrinth channels, or self-adjusting valves-configured to generate a controlled pressure drop across the device. The pressure drop is tailored to reduce inflow from higher-permeability zones or nearer wellbore sections (e.g., the heel) and thereby balance inflow contribution from lower-permeability zones or farther wellbore sections (e.g., the toe). In some embodiments, an ICD may include a tubular housing with multiple discrete restrictive openings (e.g., nozzles or valves) having known geometries and dimensions (e.g., nozzle throats between 1 mm and 10 mm in diameter) that produce a quantifiable resistance to flow under given operating conditions. ICDs may be distinct from components such as screens, packers, or perforated liners, which may allow fluid entry and which may exhibit some pressure drop, but do not incorporate the same engineered flow-restriction mechanism designed for inflow balancing.

While the present disclosure is primarily described with respect to inflow control devices (ICDs), the techniques described here may similarly be applicable for applications implementing outflow control devices (OCDs). For example, an OCD may be a downhole component configured to regulate the flow of injection fluids from the completion string into the surrounding formation. For example, in waterflooding or gas injection operations, OCDs may be used to impose a designed flow restriction that ensures uniform distribution of the injected fluid across different zones of the reservoir. Similar to ICDs, OCDs may incorporate restrictive elements such as nozzles, flow control valves, etc., to generate a controlled pressure drop tailored to limit injection into higher-permeability zones and promote injection into tighter or under-injected zones. In this way, OCDs may improve sweep efficiency and enhance overall reservoir conformance. Accordingly, embodiments described herein with respect to ICDs may encompass and/or be applicable to analogous outflow control devices deployed for injection-based applications, or OCDs.

According to some embodiments, the ICD 220 is positioned in a heel portion of the wellbore completion system 200 (or closer to a heel portion), nearer to the vertical or deviated sections of the wellbore 202, while the additional completion section 222 is positioned in a toe portion of the wellbore completion system 200 (or closer to the toe portion), further into the horizontal section of the wellbore 202. In some embodiments, positioning the additional completion section 222 in the toe portion presents additional challenges, as the lower-permeability second zone 212 must overcome both its inherent formation resistance and the increased distance and friction losses associated with flow from the toe portion of the wellbore. In some embodiments, the arrangement of the ICD 220 and the additional completion section 222 may help overcome these challenges by restricting flow at the heel and thereby promoting increased contribution from the toe. This heel-toe configuration may be implemented as part of the wellbore completion system 200 either independently of, or in addition to, the effects of formation heterogeneity. For instance, even in the absence of permeability variations, heel-toe effects may create production imbalances similar to those caused by heterogeneity, and accordingly, complex completions such as the wellbore completion system 200 may be implemented to address these challenges. Accordingly, the present techniques may be applicable to wellbore completion systems exhibiting flow disparities due to formation heterogeneities, heel-toe effects, or both.

In some embodiments, during production operations, fluids from the formation 201 flow into the wellbore completion system 200 through both the ICD 220 and the additional completion section 222. The ICD 220, via its restrictive openings 224, regulates the flow from the first zone 211 to reduce its dominance over the overall production profile, while the additional completion section 222 provides a less-restricted pathway for fluids from the second zone 212.

FIG. 2-2 illustrates a cross-section view of a restrictive opening 224 of the ICD 220, according to at least one embodiment of the present disclosure. As shown in FIG. 2-2, the restrictive opening 224 may be implemented as a nozzle 226 with a specific geometry designed to limit the flow of a production fluid 213. For example, the nozzle 226 may be sized and shaped to impose the desired artificial resistance to fluid flow, which helps to achieve a more balanced contribution from different zones of the formation 201 during production operations as described. This size, shape, and configuration of the nozzle 226 allows the inflow profile of the ICD 220 to be tailored to ensure that the higher-permeability zones do not completely dominate the production while the lower-permeability zones remain underutilized.

In some embodiments, the nozzle 226 includes an inlet 230, an outlet 232, and a throat 234. The inlet 230 is positioned at an outer surface of the ICD 220, such as at an exterior face of the completion string or within an annular region between the ICD 220 and the wellbore wall (or casing, in a cased implementation). The outlet 232 is positioned on an inner surface of the ICD 220, and provides a flow path from the formation 201 into the interior of the wellbore completion system 200. The throat 234 is positioned between the inlet 230 and the outlet 232 and represents the narrowest internal cross-section of the nozzle 226. The throat 234 may be selected to impose the desired pressure drop across the nozzle 226 and thereby restrict the rate of inflow from the formation 201. In some embodiments, inlet 230 may have a diameter of approximately 4 mm to 7 mm. In some embodiments, the outlet 232 may have a diameter of approximately 3 mm to 10 mm. In some embodiments, the throat 234 may have a diameter of approximately 1 mm to 6 mm. Other nozzle geometries and size ranges may be implemented in accordance with the techniques described herein.

In some embodiments, the restrictive opening 224 may alternatively be implemented as a restrictive valve configured to meter flow into the ICD 220. For instance, the valve may include an adjustable or self-regulating component configured to allow or restrict flow based on one or more fluid parameters. The valve may regulate flow based on fluid pressure, flow rate, viscosity, temperature, or other characteristics of the formation fluid. In this way, the valve may impose a tailored flow restriction during production to balance contributions from zones of differing permeability, similar to the functionality of the nozzle 226. In some embodiments, the restrictive openings 224 may each be implemented as the nozzle 226, as a restrictive valve, or the ICD 220 may include multiple restrictive openings 224, which may be implemented as a combination of nozzles and valves.

With reference again to FIG. 2-1, in some embodiments, while the restrictive openings 224 are configured to restrict the flow of production fluid into the completion string 204, they may not be configured to restrict flow out of the completion string 204. For example, during stimulation operations, stimulation fluid is pumped from the surface into the completion string 204 under pressure. The pressure of the stimulation fluid within the interior of the completion string 204 may be significantly higher than the formation pressure, and as a result, stimulation fluid can flow relatively freely out of the completion string 204, for instance, through the restrictive openings 224. In the context of a heterogeneous formation, this may lead to an undesirable effect during stimulation, as the stimulation fluid may preferentially flow through the restrictive openings 224 into the high-permeability first zone 211, due to the stimulation fluid encountering relatively less resistance in the first zone 211. Meanwhile, the lower-permeability second zone 212 receives little or no stimulation, despite being the target of stimulation treatment in the formation 201. Accordingly, complex completions like the completion string 204 may experience inefficiencies and/or inabilities to adequately stimulate heterogeneous formations, resulting in suboptimal treatment coverage. According to one or more embodiment, a particulate diverter slurry is described which may be delivered into completion strings to temporarily block restrictive openings to bridge and seal the restrictive openings, thereby diverting stimulation fluid to target zones that would otherwise be undertreated.

Figures 1, 3:
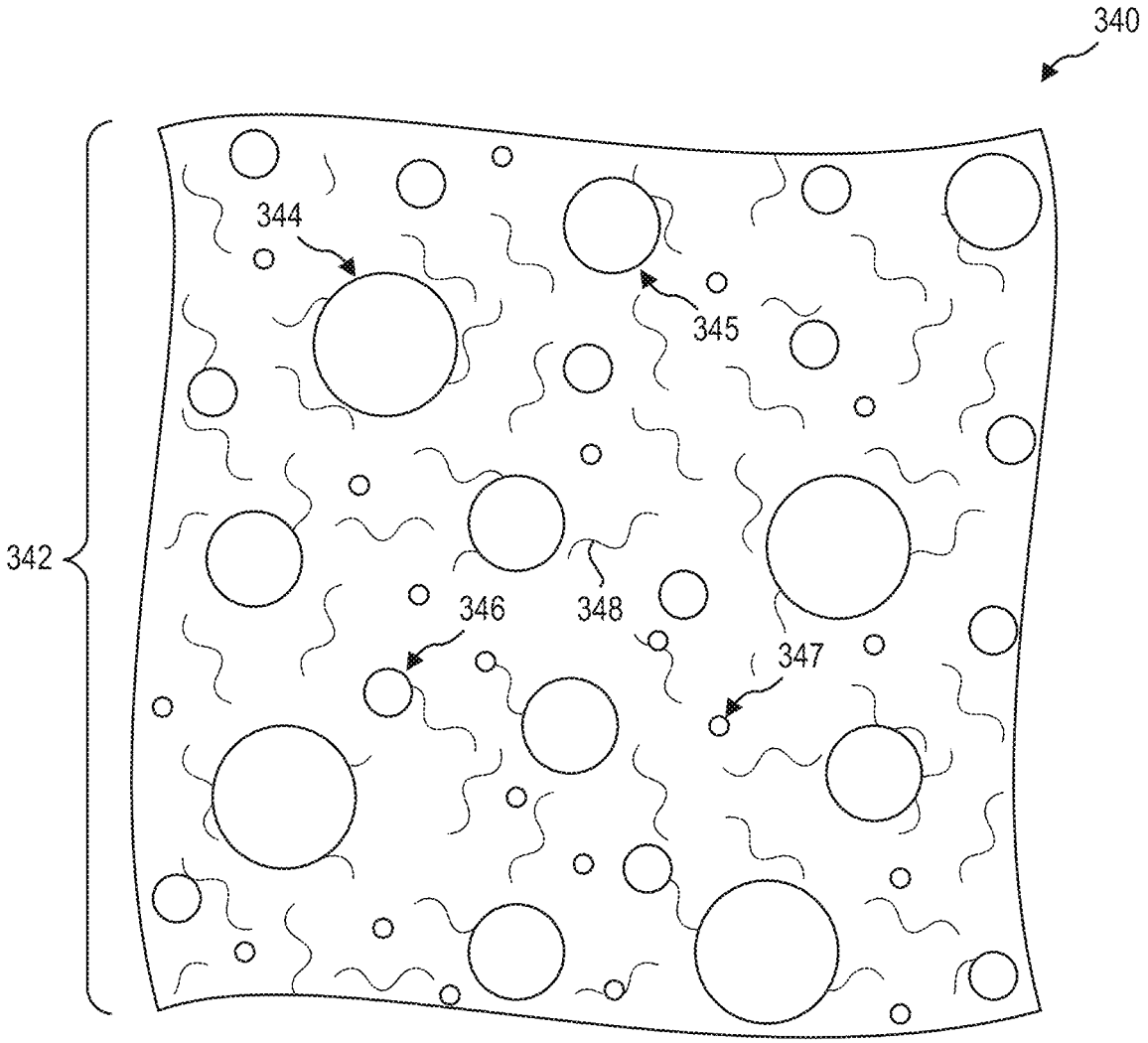
Figures 2, 3:
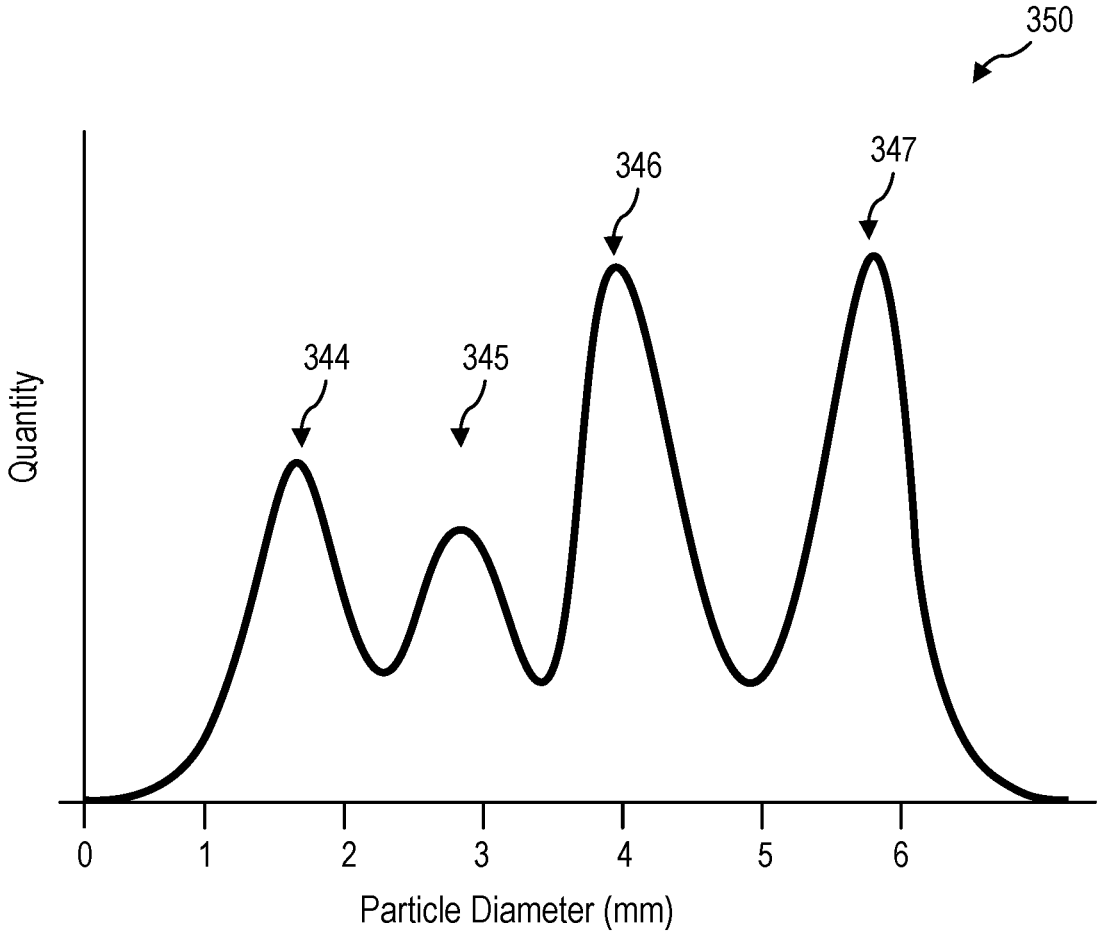

FIG. 3-1 illustrates an example of a particulate diverter (PD) 340, and FIG. 3-2 illustrates an example particle size distribution of the PD 340, according to at least one embodiment of the present disclosure. As mentioned, the PD 340 may be a fluid, mixture, composition, and/or slurry which may be delivered to a wellbore completion system in order to facilitate stimulation of one or more target formation zones.

As shown in FIG. 3-1, the PD 340 includes a plurality of diverter particles 342. In some embodiments, the diverter particles 342 include particles of varying sizes. For instance, the diverter particles 342 may collectively exhibit a multimodal particle size distribution having various distinct modes or size ranges, as illustrated in FIG. 3-2. For example, the diverter particles 342 may include a first mode 344, a second mode 345, a third mode 346, and a fourth mode 347. In some embodiments, the PD 340 includes more than 4 distinct modes, such as 5 modes, 6 modes, or more. Each mode of the particle size distribution may be selected based on the size and geometry of the restrictive openings to be temporarily blocked, such as nozzles and/or valves in an inflow control device.

In some conventional implementations, PDs have been used in contexts such as to temporarily plug cracks or fissures in a formation to divert stimulation fluid to less-penetrated zones, or to temporarily plug perforations in a casing string to balance stimulation coverage between different intervals. For instance, conventional PD usage may rely on the particles interacting with the formation itself (e.g., irregular formation voids or cracks) or interacting with a casing cemented in the wellbore (e.g., having relatively large casing perforations). In such embodiments, PDs designed for formation-interacting applications often include relatively fine particles that can enter and seal small, irregular cracks and voids. Moreover, diverter blends designed for casing perforations may use relatively large particles capable of bridging and plugging the comparatively large, perforation holes in the casing wall.

In contrast, the PD 340 described herein is particularly tailored for use with a completion string and its associated inflow control device (ICD), which includes restrictive openings having well-defined geometries and controlled dimensions. The particle size modes described herein are selected to correspond to these known geometries, such as the inlets, throats, and outlets of ICD nozzles and/or valves, enabling reliable bridging and sealing of the openings during stimulation operations. In this way, the PD 340 may be distinct from conventional PDs used for formation cracks or casing perforations, which may not reliably bridge the particular size and shape of the precisely machined restrictive openings of an ICD. As mentioned, the ICDs described herein are specifically designed with fixed, predictable flow-restriction elements (e.g., nozzles or valves) that create a measurable pressure drop to balance inflow. In some embodiments, other components that are intended to allow fluid entry without such engineered restriction may not be considered ICDs for purposes of this disclosure, such as pre-perforated liners, screens or meshes, or other fluid inflow mechanisms.

In some embodiments, the PD 340 includes a carrier fluid 348 within which the diverter particles 342 are suspended. For example, the diverter particles 342 may be mixed and suspended in the carrier fluid 348 to form a pumpable slurry. In various embodiments, the carrier fluid 348 may be water-based, oil-based, brine, acidified fluid, foamed fluid, and/or viscoelastic surfactant (VES) fluid. In some embodiments, the carrier fluid 348 may also include chemical additives such as surfactants, viscosifiers, or pH modifiers to control dispersion, stability, or placement of the diverter particles. In some embodiments, the PD 340 and/or the carrier fluid 348 may further include degradable fibers, such as elongated, thread-like structures configured to temporarily enhance particle bridging performance. For example, the degradable fibers may entangle with the diverter particles 342 within the restrictive openings, improving mechanical stability of the formed plug or bridge prior to degradation. In some embodiments, the carrier fluid 348 is selected to be compatible with the stimulation fluid that follows, for example, such that the bridge or plug formed by the diverter particles 342 remains stable during the stimulation process before degrading.

In accordance with at least one embodiment of the present disclosure, the PD 340 is formulated with at least four distinct modes of particle sizes (or particle size ranges). The modes may be particularly selected to enable bridging a corresponding flow restriction of a completion string, such as a nozzle of an ICD. For example, larger particle sizes may be selected based on the geometry of a flow restriction to correspond with bridging and/or initially forming a self-sustaining structure within the flow restriction, and successively smaller particles may provide high packing density to fill in voids between larger particles to form a stable, low-permeability plug. In one implementation, the first mode 344 may range from about 4 mm to about 6 mm. In some embodiments, the second mode 345 may range from about 3 mm to about 4 mm. In various implementations, the third mode 346 may range from about 2 mm to about 3 mm. The fourth mode 347 may range from about 1 mm to about 2 mm. In some embodiments, the size ranges may be selected such that each mode has a median size at least 3 to 15 times larger than the next smallest mode, which facilitates effective bridging, load support, and low-void plugging across a range of flow restriction geometries.

In this way, the particle size ranges of the diverter particles 342 may be particularly selected to correspond to the geometry of the flow restrictions to be sealed, such as the inlets, throats, or outlets of nozzles and/or valves of an ICD. For instance, the first mode 344 may be selected to have a median particle size that is approximately 50% to 80% of the diameter of the flow restriction to be bridged. In some embodiments, the first mode 344 may be up to 120% of the diameter of the flow restriction (e.g., nozzle throat) to be bridged. In this way, the first mode 344 may provide mechanical bridging across the restriction opening, serving as a primary load-bearing skeleton of the formed plug. The second mode 345 may be sized to fit between the larger particles of the first mode 344, supporting the bridge and distributing loads. The third mode 346 and fourth mode 347 may be selected to fill increasingly smaller voids between the larger particles, increasing the packing volume fraction (PVF) of the plug. In some implementations, the four modes may provide a PVF of 0.75 or greater, and in some embodiments 0.80 or greater, to ensure low leakage and/or substantial sealing of the opening.

In some embodiments, the diverter particles 342 are degradable and are selected to temporarily seal restrictive openings during stimulation, and subsequently degrade to restore flow through the restrictive openings. The diverter particles 342 may be made of a natural, synthetic, and/or composite material, such as a degradable polymer. For example, the diverter particles 342 may include polylactic acid (PLA), polyglycolic acid (PGA), copolymers such as poly(lactide-co-glycolide), or other suitable degradable material. In some implementations, the diverter particles 342 include salts such as calcium carbonate or magnesium carbonate. The diverter particles 342 may include oxides such as magnesium oxide, which degrade upon exposure to acidic treatment fluids.

In some implementations, the diverter particles 342 are configured to degrade based on a temperature degradation mechanism. For example, the diverter particles 342 may be susceptible to degradation based on temperatures experienced in the downhole environment. In some embodiments, a degradation temperature of the diverter particles 342 ranges from about 250° F. to about 300° F. In certain embodiments, the degradation temperature of the diverter particles 342 ranges from about 150° F. to about 250° F. Having a lower relative degradation temperature in some embodiments may facilitate the present techniques being more widely applicable, for example, to wellbore operations and/or environments which may experience lower relative wellbore temperatures, such as injector wells. In some embodiments, the degradation temperature is more than 300° F. In this way, the diverter particles 342 may be subject to thermal degradation, and may degrade to clear the restrictive openings based on a wide variety of environmental temperature of the wellbore.

In certain embodiments, the diverter particles 342 are designed to degrade by one or more chemical and/or physical degradation mechanisms, either in addition to or as an alternative to thermal degradation. For example, in some embodiments, the diverter particles 342 may be water-soluble or reactive with aqueous fluids. In other embodiments, the diverter particles 342 degrade by hydrolysis in the presence of water, acid, or base. The degradation mechanism may be triggered by the pH or composition of a subsequent treatment fluid. For instance, diverter particles 342 composed of magnesium oxide may degrade upon exposure to acid, while salts such as calcium carbonate may dissolve in low-pH environments. Polymers such as PLA or PGA may degrade by hydrolysis under neutral to mildly basic conditions and elevated temperature. In some implementations, chemical agents may be introduced to accelerate degradation, for instance, if plug clearance does not occur sufficiently quickly from thermal degradation mechanisms.

In some embodiments, the diverter particles 342 degrade over a degradation period, which may correspond to a time interval from initiation of a degradation mechanism (e.g., thermal or chemical degradation) until substantial or complete loss of sealing functionality. The degradation period may depend on the material composition, temperature, and fluid environment. For example, in some embodiments, the degradation period may be at least 4 hours or at least 8 hours. In some embodiments, the degradation period may be up to 24 hours or up to 48 hours. In some embodiments, the degradation period may be engineered to be less than 24 hours, such as for rapid post-stimulation flowback. In other embodiments, degradation periods longer than 48 hours may be implemented, for example, in deeper wells or colder formations.

In some embodiments, the diverter particles 342 may take various shapes, for example, to enhance the stability and sealing behavior of a formed plug. For example, the particles may be spherical, angular, flake-like, clover-shaped, rod-shaped, or other shapes and combinations thereof. In some embodiments, one or more diverter particles 342 may include shapes such as trefoils or quatrefoils, for instance, to further improve frictional interlocking and structural integrity of the formed seal. The shape and surface properties may be selected to increase mechanical interlock and reduce mobility once the plug is formed within the restrictive openings.

As mentioned, FIG. 3-2 illustrates an example particle size distribution plot 350 of the PD 340 of FIG. 3-1, according to at least one embodiment of the present disclosure. As shown, the particle size distribution plot 350 includes the four distinct modes 344, 345, 346, and 347. These modes correspond to various size ranges of the diverter particles 342 as mentioned above. The four-mode distribution provides a broad range of particle sizes for bridging, packing, and sealing flow restrictions of various geometries. For example, the larger particles corresponding to the first mode 344 may initiate bridging across a restrictive opening (e.g., an inlet or throat of a nozzle), while smaller particles corresponding to the second mode 345 and third mode 346 may fill in and support the seal structure. Still smaller particles corresponding to the fourth mode 347 may further fill in and seal interstitial spaces between larger-sized particles.

In some implementations, the relative proportions of the four modes may be tuned to optimize placement and sealing for a given application. For instance, the size of the (largest) first mode 344 may be selected based on corresponding to a diameter of the inlet and/or throat of a nozzle. For example, the first mode 344 may be approximately the same size as, or slightly larger than, the nozzle throat diameter to ensure bridging. In some embodiments, a blend with a higher fraction of intermediate particles may provide better compaction into an associated nozzle size. In some embodiments, a blend with more large particles may improve initial bridging performance in an associated nozzle size. In this way, the particle size distribution may be selected based on the size and/or geometry of the associated opening (e.g., nozzle) to block, such as for balancing flowability during placement, plugging effectiveness during sealing, degradation performance post-treatment, and other performance factors directly associated with the corresponding restrictive opening to be plugged.

Figures 1, 4:
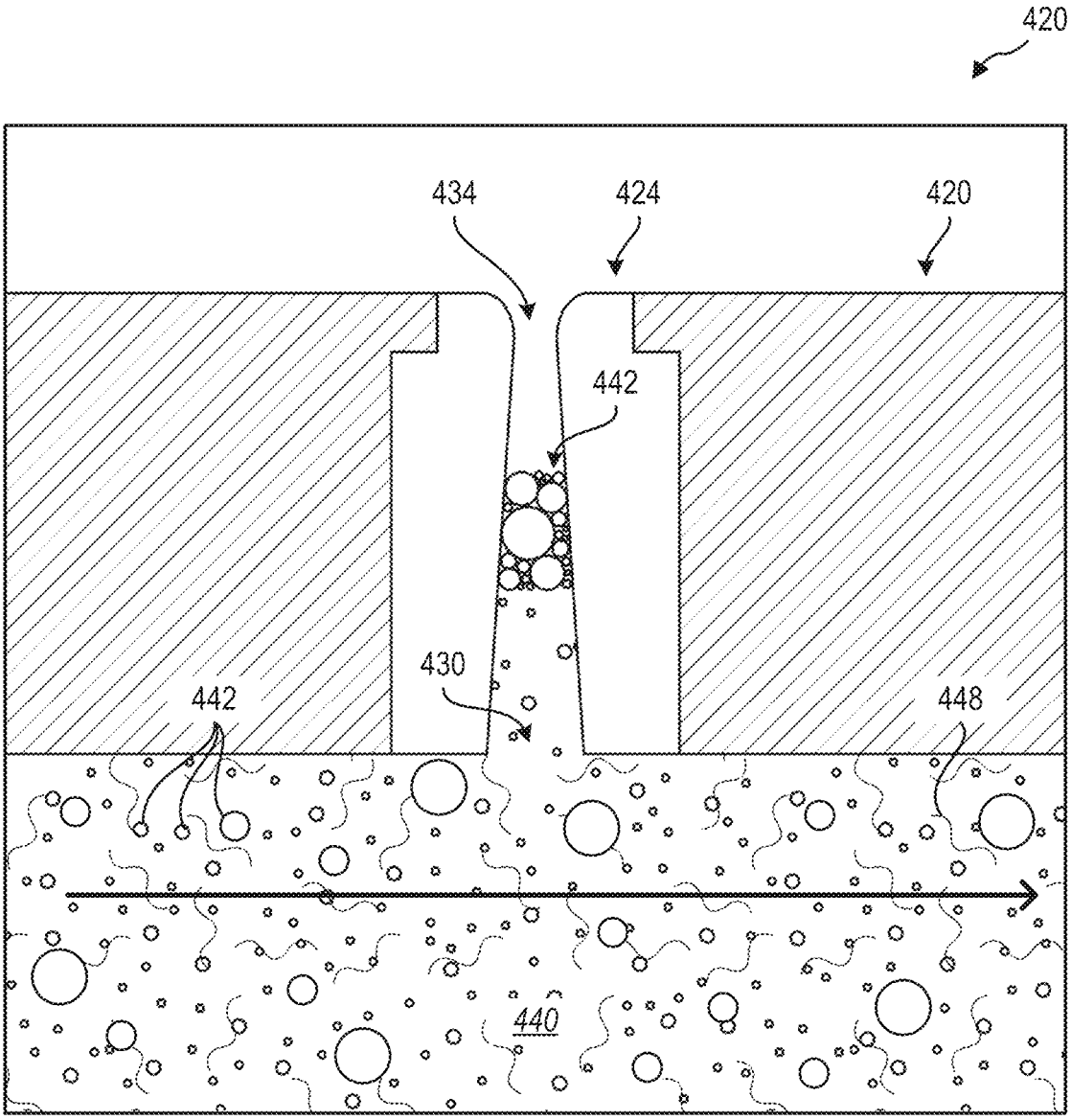
Figures 2, 4:
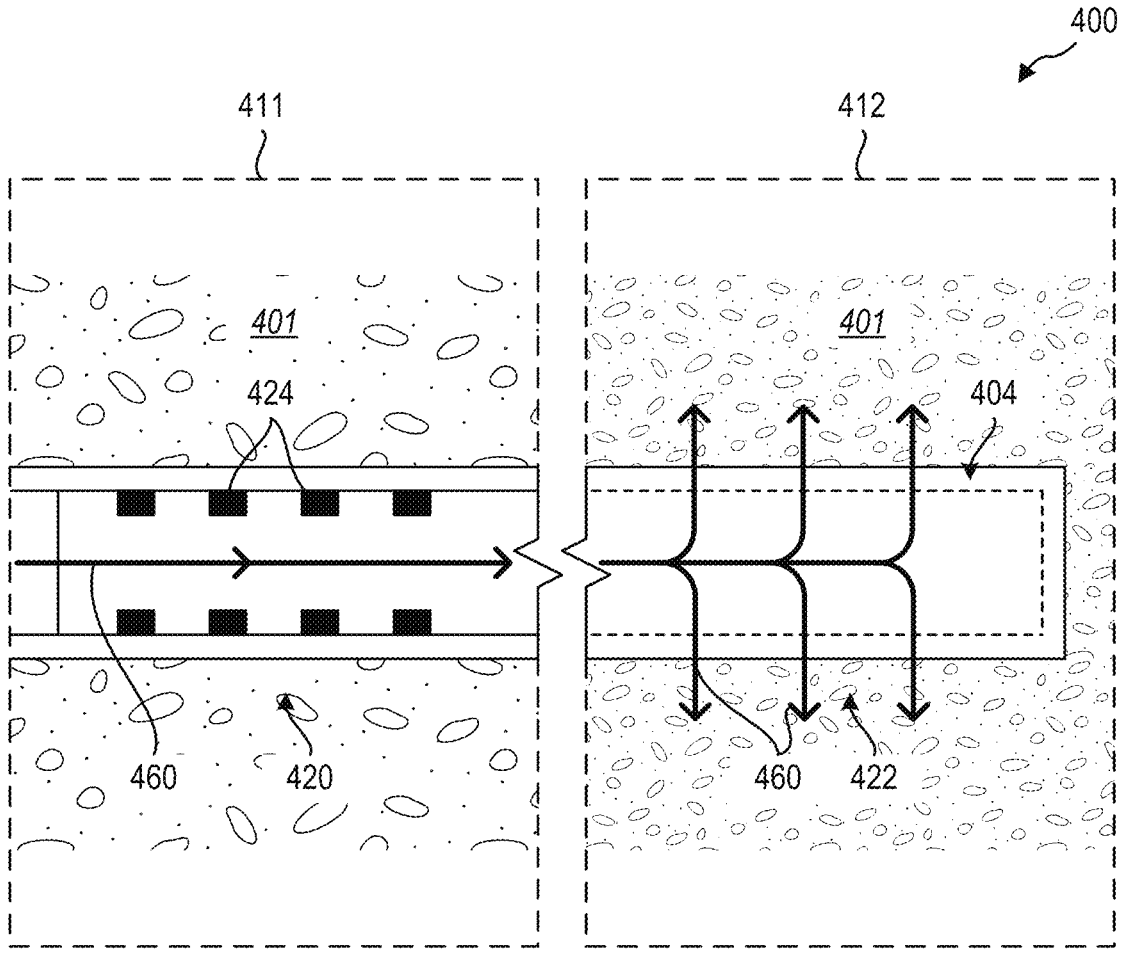

FIG. 4-1 illustrates a schematic view of a restrictive opening 424 of an ICD 420 with diverter particles 442 bridging and sealing the restrictive opening 424, according to at least one embodiment of the present disclosure. FIG. 4-2 shows a schematic view of a wellbore completion system 400 during a stimulation operation, with the wellbore completion system 400 including the ICD 420 having sealed restrictive openings 424 as described in FIG. 4-1, according to at least one embodiment of the present disclosure.

As shown in FIG. 4-1, a PD 440 (e.g., a slurry) is delivered through an inner bore of the ICD 420. As described herein, the PD 440 includes diverter particles 442 suspended in a carrier fluid 448 as previously discussed. As the PD 440 encounters the restrictive opening 424, larger diverter particles may be sized to bridge across a throat 434 of the restrictive opening 424 (e.g., a nozzle in this implementation). In some embodiments, the diverter particles 442 may be sized and configured to additionally or alternatively bridge at an inlet 430 of the restrictive opening 424. In this way, an initial formation of a plug or seal may be formed. Intermediate-sized particles may then accumulate between and/or around the larger particles, progressively reducing void space within the bridge. Smaller particles may subsequently fill remaining interstitial spaces and further seal the restrictive opening 424. In some embodiments, the resulting plug substantially or completely seals the restrictive opening 424, preventing stimulation fluid from flowing through the ICD 420.

Turning now to FIG. 4-2, during a subsequent stimulation operation, the restrictive openings 424 of the ICD 420 have now been blocked by the PD 440, illustrated as filled-in or darkened elements in this figure. During stimulation, a stimulation fluid 460 is pumped downhole and flows past the now-blocked ICD 420. The stimulation fluid 460 is instead directed into an additional completion section 422. The additional completion section 422, which is positioned in a lower-relative-permeability second zone 412 of a formation 401, allows the stimulation fluid 460 to exit the completion string 404 and enter the formation 401 where treatment is needed. In this way, the PD 440 facilitates diversion of the stimulation fluid 460 away from a higher-relative-permeability first zone 411—which might otherwise receive most of the stimulation fluid—and toward the second zone 412, improving treatment coverage and efficiency.

In some embodiments, the plug formed by the PD 440 is capable of withstanding differential pressure between the interior of the completion string 404 and the formation 401 typical of stimulation operations. For example, stimulation operations may involve pressure differentials across the restrictive openings 424 on the order of 1,000 psi to 5,000 psi or more, depending on treatment type and depth. In contrast, during production, the pressure differential across the same restrictive openings 424 may be significantly lower, such as between 50 psi and 500 psi or higher. The plug formed by the PD 440 is therefore configured to resist relatively high pressure during stimulation, while also degrading cleanly post-treatment to avoid obstructing the lower-pressure production flow.

In some embodiments, the multimodal particle size distribution of the PD 440 allows the plug to reliably bridge restrictive openings 424 having various sizes and geometries, for example in implementations where the ICD 420 includes multiple different-sized nozzle and/or valve types. Following stimulation, the diverter particles 442 degrade as described in one or more embodiments herein to restore flow through the restrictive openings 424. This degradation allows production operations to resume, including production fluid flowing into the ICD 420 through the previously sealed restrictive openings. Because the second zone 412 has now been effectively stimulated, production fluid from both the first zone 411 and the second zone 412 may contribute more uniformly to overall production. In this way, the present techniques may enhance recovery efficiency and increase production rates from the wellbore completion system 400.

Figure 5:
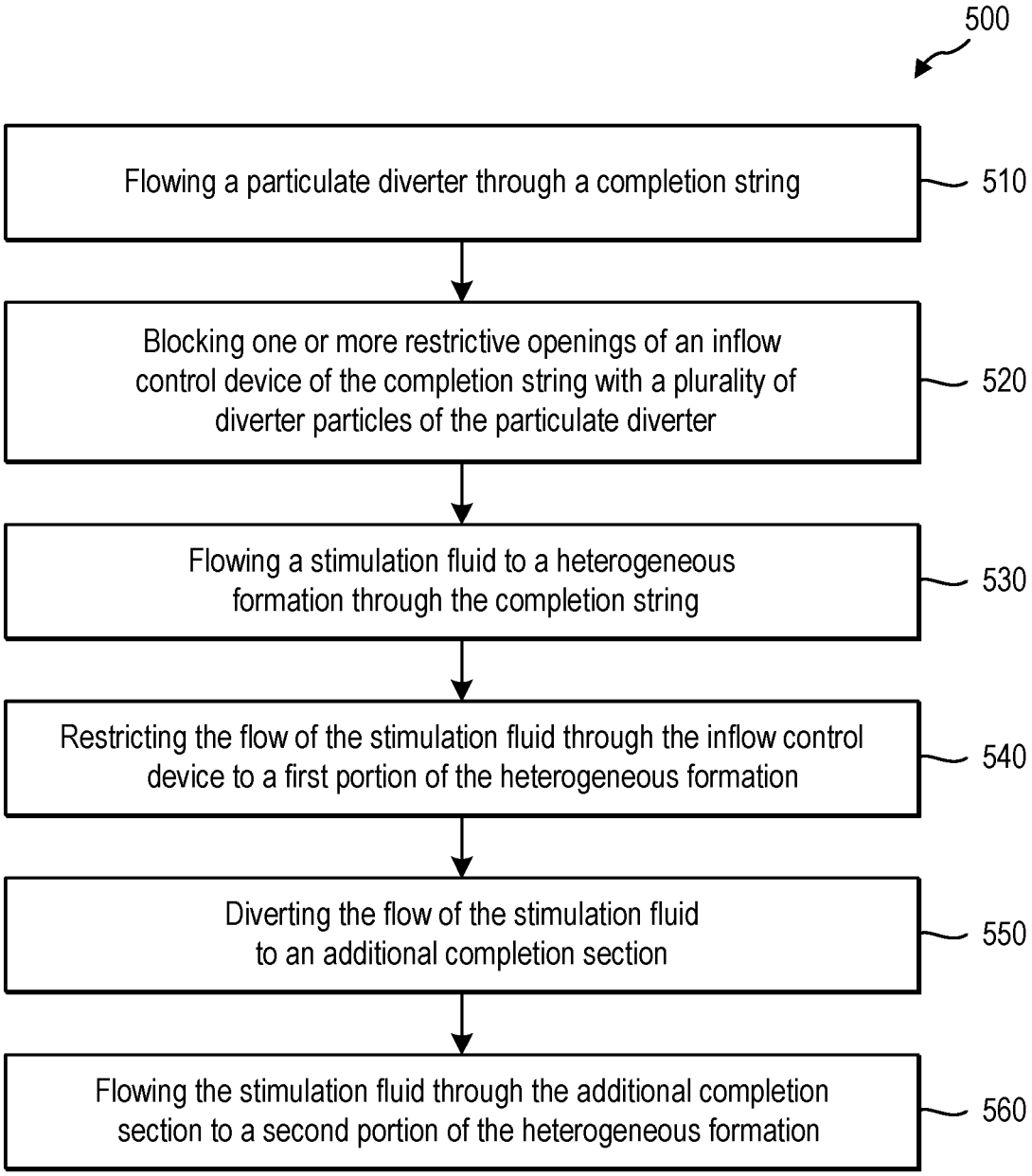
FIG. 5 illustrates a flow diagram for a method or a series of acts of stimulating a heterogeneous formation, according to at least one embodiment of the present disclosure.

FIG. 5 illustrates a flow diagram for a method 500 or a series of acts for stimulating a heterogeneous formation, according to at least one embodiment of the present disclosure. While FIG. 5 illustrates acts according to one embodiment, alternative embodiments may add to, omit, reorder, or modify any of the acts of FIG. 5

In some embodiments, the method 500 includes an act 510 of flowing a particulate diverter through a completion string. For example, the act 510 may include flowing a particulate diverter through a completion string within a wellbore positioned within the heterogeneous formation, wherein the particulate diverter comprises a plurality of diverter particles having a multimodal particle size distribution with at least four modes.

In some embodiments, the method 500 includes an act 520 of blocking one or more restrictive openings of an inflow control device of the completion string with a plurality of diverter particles of the particulate diverter. For example, the act 520 may include blocking one or more restrictive openings of an inflow control device of the completion string with the plurality of diverter particles of the particulate diverter, the plurality of diverter particles being sized and configured according to the at least four modes and based on a size of the one or more restrictive openings, wherein the one or more restrictive openings of the inflow control device are configured to restrict a flow of a production fluid into the completion string from the heterogeneous formation.

In some embodiments, the method 500 includes an act 530 of flowing a stimulation fluid to a heterogeneous formation through the completion string. In some embodiments, the act 530 may include one or more sub acts. For example, the act 530 may include an act 540 of restricting the flow of the stimulation fluid through the inflow control device to a first portion of the heterogeneous formation. For example, the act 530 may include restricting the flow of the stimulation fluid through the inflow control device to a first portion of the heterogeneous formation having a first permeability, based on the plurality of diverter particles blocking the one or more restrictive openings.

In some embodiments, the act 530 includes an act 550 of diverting the flow of the stimulation fluid to an additional completion section. For example, the act 550 may include diverting the flow of the stimulation fluid to an additional completion section of the completion string based on restricting the flow of the stimulation fluid through the inflow control device.

In some embodiments, the act 530 may include an act 560 of flowing the stimulation fluid through the additional completion section to a second portion of the heterogeneous formation. For example, the act 560 may include flowing the stimulation fluid through the additional completion section of the completion string to a second portion of the heterogeneous formation having a second permeability that is less than the first permeability to stimulate the second portion of the heterogeneous formation. In some embodiments, the stimulation fluid is acid, and the heterogeneous formation is a carbonate formation.

In some embodiments, the plurality of diverter particles are degradable, and the method further includes clearing the one or more restrictive openings based on the plurality of diverter particles degrading over a degradation period; and after the degradation period: producing the production fluid into the completion string through the one or more restrictive openings of the inflow control device from the first portion of the heterogeneous formation; and producing the production fluid into the completion string through the additional completion section from the second portion of the heterogeneous formation at an increased rate based on stimulating the second portion of the heterogeneous formation.

INDUSTRIAL APPLICABILITY

The following description from ¶¶ [0065]-[0084] includes various embodiments that, where feasible, may be combined in any permutation. For example, the embodiment of ¶ [0065] may be combined with any or all embodiments of the following paragraphs. Embodiments that describe acts of a method may be combined with embodiments that describe, for example, systems and/or devices. Any permutation of the following paragraphs is considered to be hereby disclosed for the purposes of providing "unambiguously derivable support" for any claim amendment based on the following paragraphs. Furthermore, the following paragraphs provide support such that any combination of the following paragraphs would not create an "intermediate generalization."

In some embodiments, a particulate diverter is described herein for use in a wellbore completion system including an inflow control device configured to produce a production fluid from a heterogeneous formation. The particulate diverter includes a carrier fluid; and a plurality of diverter particles suspended in the carrier fluid, wherein: the plurality of diverter particles are degradable; the plurality of diverter particles have a multimodal particle size distribution including at least four modes; and the plurality of diverter particles are sized and configured, based on the at least four modes, to temporarily bridge restrictive openings of the inflow control device during a stimulation operation of the heterogeneous formation with the wellbore completion system.

In some embodiments, each mode of the at least four modes of the multimodal particle size distribution corresponds to a different particle size range of the plurality of diverter particles.

In some embodiments, the multimodal particle size distribution includes at least six modes sized and configured to temporarily bridge the restrictive openings of the inflow control device during the stimulation operation of the heterogeneous formation.

In some embodiments, the plurality of diverter particles are configured to degrade under downhole conditions within a period of between 4 and 48 hours after bridging the restrictive openings of the inflow control device.

In some embodiments, the at least four modes of the multimodal particle size distribution include particle sizes of about 2 mm to about 10 mm.

In some embodiments, the restrictive openings of the inflow control device include one or more of a nozzle sized and shaped to restrict a flow of a production fluid into the inflow control device or a valve configured to restrict the flow of the production fluid into the inflow control device.

In some embodiments, the restrictive openings include one or more nozzles, and the plurality of diverter particles are sized, based on the at least 4 modes of the multimodal particle size distribution, to temporarily bridge the restrictive openings of the inflow control device having a nozzle throat size of between about 1 mm and about 6 mm.

In some embodiments, the plurality of diverter particles comprise one or more of a degradable polymer, a degradable salt, or a degradable composite material.

In some embodiments, the plurality of diverter particles are configured to degrade by one or more of heat or chemical dissolution.

In some embodiments, a wellbore completion system implemented in a wellbore for producing a production fluid from a heterogeneous formation includes a completion string, comprising an inflow control device positioned in the wellbore at a first portion of the heterogeneous formation exhibiting a first permeability that is greater than a second permeability at a second portion of the heterogeneous formation, wherein the inflow control device includes one or more restrictive openings configured to restrict a flow of the production fluid into the completion string at the first portion of the heterogeneous formation exhibiting the first permeability; and a particulate diverter flowing within the completion string, the particulate diverter comprising a plurality of diverter particles having a multimodal particle size distribution including at least four modes, wherein the plurality of diverter particles are sized, based on the at least four modes, to bridge the one or more restrictive openings of the inflow control device.

In some embodiments, the plurality of diverter particles are sized, based on a size of the one or more restrictive openings, to bridge the one or more restrictive openings and to form a seal at the one or more restrictive openings such that, during a stimulation operation of the heterogeneous formation, a stimulation fluid is diverted from the first portion of the heterogeneous formation to the second portion of the heterogeneous formation.

In some embodiments, the completion string further includes an additional completion section positioned in the wellbore at the second portion of the heterogeneous formation having a second permeability that is less than the first permeability, and wherein the one or more restrictive openings of the inflow control device are configured to, during production, restrict the flow of the production fluid into the completion string at the first portion of the heterogeneous formation to increase the relative flow of the production fluid into the completion string at the second portion of the heterogeneous formation.

In some embodiments, the additional completion section is a non-restrictive completion section and includes one or more of a pre-perforated liner, a limited-entry liner, or an open-hole interval of the completion string.

In some embodiments, the inflow control device is positioned at a heel of the completion string and the additional completion section is positioned at a toe of the completion string.

In some embodiments, the one or more restrictive openings include one or more nozzles sized and shaped to impose artificial flow resistance to the production fluid entering the completion string at the first portion of the heterogeneous formation.

In some embodiments, the particulate diverter further includes a carrier fluid and the plurality of diverter particles are suspended in the carrier fluid to form a slurry.

In some embodiments, the plurality of diverter particles are degradable to temporarily bridge the one or more restrictive openings of the inflow control device.

In some embodiments, a method of stimulating a heterogeneous formation includes flowing a particulate diverter through a completion string within a wellbore positioned within the heterogeneous formation, wherein the particulate diverter comprises a plurality of diverter particles having a multimodal particle size distribution with at least four modes; bridging one or more restrictive openings of an inflow control device of the completion string with the plurality of diverter particles of the particulate diverter, the plurality of diverter particles being sized and configured according to the at least four modes and based on a size of the one or more restrictive openings, wherein the one or more restrictive openings of the inflow control device are configured to restrict a flow of a production fluid into the completion string from the heterogeneous formation; and flowing a stimulation fluid to the heterogeneous formation through the completion string, including: restricting the flow of the stimulation fluid through the inflow control device to a first portion of the heterogeneous formation having a first permeability, based on the plurality of diverter particles bridging the one or more restrictive openings; diverting the flow of the stimulation fluid to an additional completion section of the completion string based on restricting the flow of the stimulation fluid through the inflow control device; and flowing the stimulation fluid through the additional completion section of the completion string to a second portion of the heterogeneous formation having a second permeability that is less than the first permeability to stimulate the second portion of the heterogeneous formation.

In some embodiments, the stimulation fluid is acid, and the heterogeneous formation is a carbonate formation.

In some embodiments, the plurality of diverter particles are degradable, and the method further includes clearing the one or more restrictive openings based on the plurality of diverter particles degrading over a degradation period; and after the degradation period: producing the production fluid into the completion string through the one or more restrictive openings of the inflow control device from the first portion of the heterogeneous formation; and producing the production fluid into the completion string through the additional completion section from the second portion of the heterogeneous formation at an increased rate as a result of stimulating the second portion of the heterogeneous formation.

The embodiments of the present techniques have been primarily described with reference to wellbore drilling operations; the techniques described herein may be used in applications other than the drilling of a wellbore. In other embodiments, the techniques according to the present disclosure may be used outside a wellbore or other downhole environment used for the exploration or production of natural resources. For instance, techniques of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements. Additionally, as used herein, the term "and/or" includes any and all combinations of one or more of the associated listed items.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A particulate diverter for use in a wellbore completion system including an inflow control device configured to produce a production fluid from a heterogeneous formation, the particulate diverter comprising:

a carrier fluid; and a plurality of diverter particles suspended in the carrier fluid, wherein:

the plurality of diverter particles are degradable;

the plurality of diverter particles have a multimodal particle size distribution including at least four modes;

the plurality of diverter particles are sized and configured, based on the at least four modes, to temporarily bridge restrictive openings of the inflow control device during a stimulation operation of the heterogeneous formation with the wellbore completion system;

the inflow control device has a plurality of nozzles mounted in a tubular housing, each nozzle defining a restrictive opening having a throat between and lesser in diameter than an inner aperture along an inner surface of the tubular housing and an outer aperture along an outer surface of the tubular housing.

2. The particulate diverter of claim 1, wherein each mode of the at least four modes of the multimodal particle size distribution corresponds to a different particle size range of the plurality of diverter particles.

3. The particulate diverter of claim 1, wherein the multimodal particle size distribution includes at least six modes sized and configured to temporarily bridge the restrictive openings of the inflow control device during the stimulation operation of the heterogeneous formation.

4. The particulate diverter of claim 1, wherein the plurality of diverter particles are configured to degrade under downhole conditions within a period of between 4 and 48 hours after bridging the restrictive openings of the inflow control device.

5. The particulate diverter of claim 1, wherein the at least four modes of the multimodal particle size distribution include particle sizes of about 2 mm to about 10 mm.

6. The particulate diverter of claim 1, wherein the restrictive openings of the inflow control device include one or more of a nozzle sized and shaped to restrict a flow of the production fluid into the inflow control device or a valve configured to restrict the flow of the production fluid into the inflow control device.

7. The particulate diverter of claim 1, wherein the plurality of diverter particles are sized, based on the at least 4 modes of the multimodal particle size distribution, to temporarily bridge the restrictive openings of the inflow control device having a nozzle throat size of between about 1 mm and about 6 mm.

8. The particulate diverter of claim 1, wherein the plurality of diverter particles comprise one or more of a degradable polymer, a degradable salt, or a degradable composite material.

9. The particulate diverter of claim 1, wherein the plurality of diverter particles are configured to degrade by one or more of heat or chemical dissolution.

10. A wellbore completion system implemented in a wellbore for producing a production fluid from a heterogeneous formation, including:

a completion string, comprising an inflow control device positioned in the wellbore at a first portion of the heterogeneous formation exhibiting a first permeability that is greater than a second permeability at a second portion of the heterogeneous formation, wherein the inflow control device includes one or more nozzles mounted in a tubular housing, each nozzle defining a restrictive opening having a throat between and lesser in diameter than an inner aperture along an inner surface of the tubular housing and an outer aperture along an outer surface of the tubular housing, the one or more nozzles being configured to restrict a flow of the production fluid into the completion string at the first portion of the heterogeneous formation exhibiting the first permeability; and a particulate diverter flowing within the completion string, the particulate diverter comprising a plurality of diverter particles having a multimodal particle size distribution including at least four modes, wherein the plurality of diverter particles are sized, based on the at least four modes, to bridge the one or more restrictive openings of the inflow control device.

11. The wellbore completion system of claim 10, wherein the plurality of diverter particles are sized, based on a size of the one or more restrictive openings, to bridge the one or more restrictive openings and to form a seal at the one or more restrictive openings such that, during a stimulation operation of the heterogeneous formation, a stimulation fluid is diverted from the first portion of the heterogeneous formation to the second portion of the heterogeneous formation.

12. The wellbore completion system of claim 10, wherein the completion string further includes an additional completion section positioned in the wellbore at the second portion of the heterogeneous formation having the second permeability that is less than the first permeability, and wherein the one or more nozzles of the inflow control device are configured to, during production, restrict the flow of the production fluid into the completion string at the first portion of the heterogeneous formation to increase the flow of the production fluid into the completion string at the second portion of the heterogeneous formation.

13. The wellbore completion system of claim 12, wherein the additional completion section is a non-restrictive completion section and includes one or more of a pre-perforated liner, a limited-entry liner, or an open-hole interval of the completion string.

14. The wellbore completion system of claim 12, wherein the inflow control device is positioned at a heel of the completion string and the additional completion section is positioned at a toe of the completion string.

15. The wellbore completion system of claim 10, wherein the restrictive openings are sized and shaped to impose artificial flow resistance to the production fluid entering the completion string at the first portion of the heterogeneous formation.

16. The wellbore completion system of claim 10, wherein the particulate diverter further includes a carrier fluid and the plurality of diverter particles are suspended in the carrier fluid to form a slurry.

17. The wellbore completion system of claim 10, wherein the plurality of diverter particles are degradable to temporarily bridge the one or more restrictive openings of the inflow control device.

18. A method of stimulating a heterogeneous formation, comprising:

flowing a particulate diverter through a completion string within a wellbore positioned within the heterogeneous formation, wherein the particulate diverter comprises a plurality of diverter particles having a multimodal particle size distribution with at least four modes;

bridging one or more nozzles mounted in a tubular housing of an inflow control device of the completion string with the plurality of diverter particles of the particulate diverter, each nozzle defining a restrictive opening having a throat between and lesser in diameter than an inner aperture along an inner surface of the tubular housing and an outer aperture along an outer surface of the tubular housing, the plurality of diverter particles being sized and configured according to the at least four modes and based on a size of the one or more restrictive openings, wherein the one or more restrictive openings of the inflow control device are configured to restrict a flow of a production fluid into the completion string from the heterogeneous formation; and flowing a stimulation fluid to the heterogeneous formation through the completion string, including:

restricting the flow of the stimulation fluid through the inflow control device to a first portion of the heterogeneous formation having a first permeability, based on the plurality of diverter particles bridging the one or more restrictive openings;

diverting the flow of the stimulation fluid to an additional completion section of the completion string based on restricting the flow of the stimulation fluid through the inflow control device; and flowing the stimulation fluid through the additional completion section of the completion string to a second portion of the heterogeneous formation having a second permeability that is less than the first permeability to stimulate the second portion of the heterogeneous formation.

19. The method of claim 18, wherein the stimulation fluid is acid, and the heterogeneous formation is one or more of a carbonate or a sandstone formation.

20. The method of claim 18, wherein the stimulation fluid is acid, the heterogeneous formation is one or more of a carbonate or a sandstone formation, and the plurality of diverter particles are degradable, and the method further comprises:

clearing the one or more restrictive openings based on the plurality of diverter particles degrading over a degradation period; and after the degradation period:

producing the production fluid into the completion string through the one or more restrictive openings of the inflow control device from the first portion of the heterogeneous formation; and producing the production fluid into the completion string through the additional completion section from the second portion of the heterogeneous formation at an increased flow rate as a result of stimulating the second portion of the heterogeneous formation.

* * * * *